United States Patent [19]

Mathes et al.

[11] Patent Number: 4,530,283

[45] Date of Patent: Jul. 23, 1985

[54] CHANGEOVER PROTECTION SYSTEM FOR PERFECTING PRINTING MACHINES

[75] Inventors: Josef Mathes; Paul Abendroth, both of Offenbach am Main; Roland Holl, Weiterstadt; Wolfgang Seikel, Offenbach am Main, all of Fed. Rep. of Germany

[73] Assignee: M.A.N.-Roland Druckmaschinen Aktiengesellschaft, Fed. Rep. of Germany

[21] Appl. No.: 604,740

[22] Filed: Apr. 27, 1984

[30] Foreign Application Priority Data

Apr. 28, 1983 [DE] Fed. Rep. of Germany ..... 3315445

[51] Int. Cl.[3] ..... B41F 5/02; B41F 21/04

[52] U.S. Cl. ..... 101/230; 101/410

[58] Field of Search ..... 101/230, 229, 231, 232, 101/220, 221, 222, 223, 224, 225, 183, 410, 184; 271/DIG. 9, 82, 225

[56] References Cited

U.S. PATENT DOCUMENTS 4,014,261 3/1977 Becker ..... 101/230

4,122,773 10/1978 Wirz ..... 101/230

4,147,105 4/1979 Becker ..... 101/230

*Primary Examiner*—J. Reed Fisher

*Attorney, Agent, or Firm*—Leydig, Voit, Osann Mayer & Holt, Ltd.

[57] ABSTRACT

The turning cylinder and storage cylinder in a perfecting printing press is provided with changeover mechanisms having spring-loaded electromagnetically releasable latches and sensors for detecting latched adjustments. Moreover, a contactless sensor is provided for detecting clamping of the calendering suckers in the storage cylinder even when the cylinder is rotating. Contactless proximity switches determine the correct phase adjustments between the storage cylinder and the turning cylinder for both perfecting and first form printing. An access door and interlock guarantees that the cylinders are turned to a normal position and braked before the access door is opened, and the access door cannot be closed for subsequent printing until changeover has been completed. An indicator array indicates the sequence of adjustments to follow and abnormal conditions.

19 Claims, 15 Drawing Figures

(PERFECTING)

(FIRST FORM)

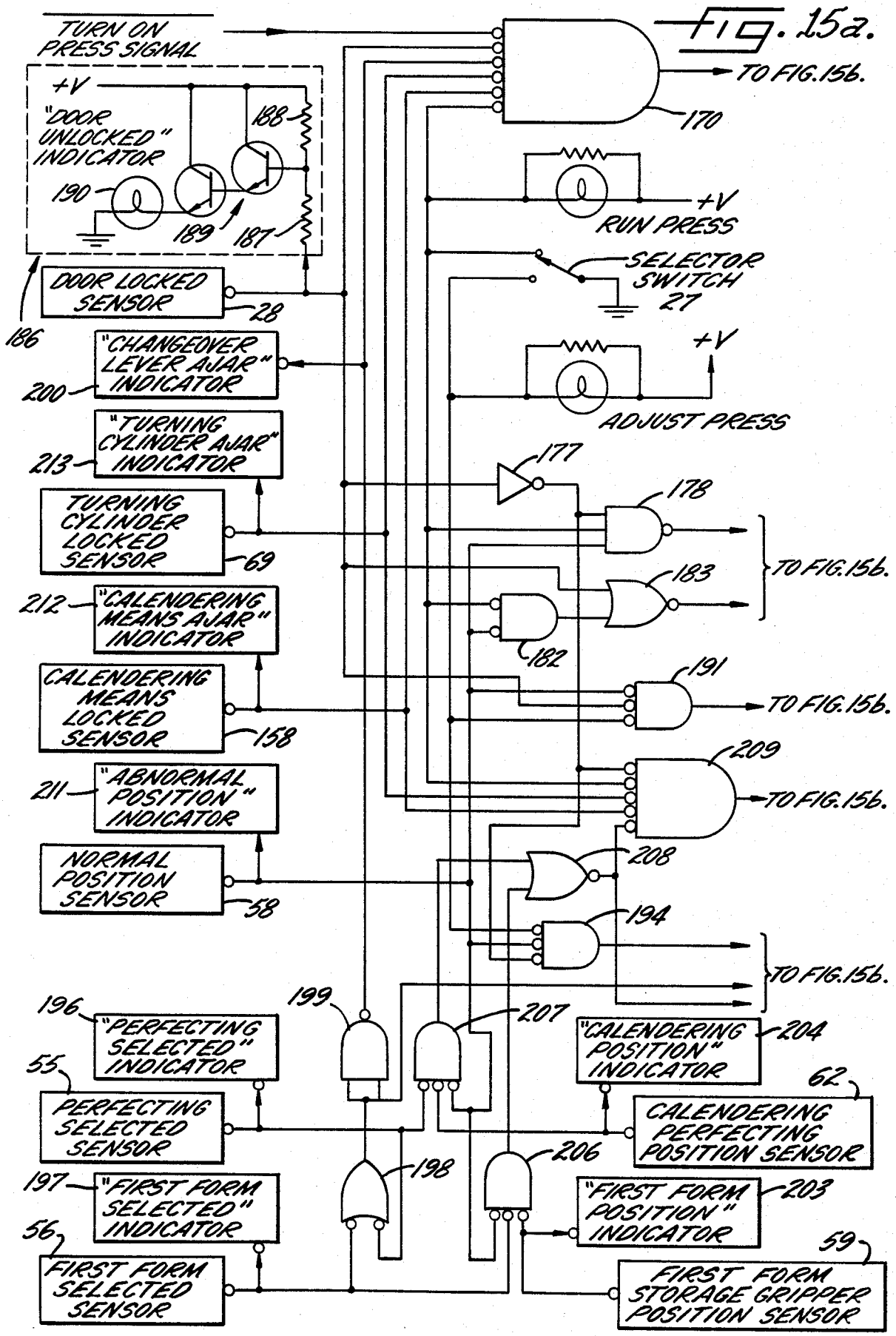
Fig. 15a.
TURN ON PRESS SIGNAL
+V
"DOOR UNLOCKED" INDICATOR
188
190
189
187
186
DOOR LOCKED SENSOR
28
"CHANGEOVER LEVER AJAR" INDICATOR
200
"TURNING CYLINDER AJAR" INDICATOR
213
TURNING CYLINDER LOCKED SENSOR
69
"CALENDERING MEANS AJAR" INDICATOR
212
CALENDERING MEANS LOCKED SENSOR
158
"ABNORMAL POSITION" INDICATOR
211
NORMAL POSITION SENSOR
58
"PERFECTING SELECTED" INDICATOR
196
PERFECTING SELECTED SENSOR
55
"FIRST FORM SELECTED" INDICATOR
197
FIRST FORM SELECTED SENSOR
56
TO FIG.15b.
170
+V
RUN PRESS
SELECTOR SWITCH 27
+V
ADJUST PRESS
177
178
183
182
191
209
208
194
199
207
198
206
"CALENDERING POSITION" INDICATOR
204
CALENDERING PERFECTING POSITION SENSOR
62
"FIRST FORM POSITION" INDICATOR
203
FIRST FORM STORAGE GRIPPER POSITION SENSOR
59

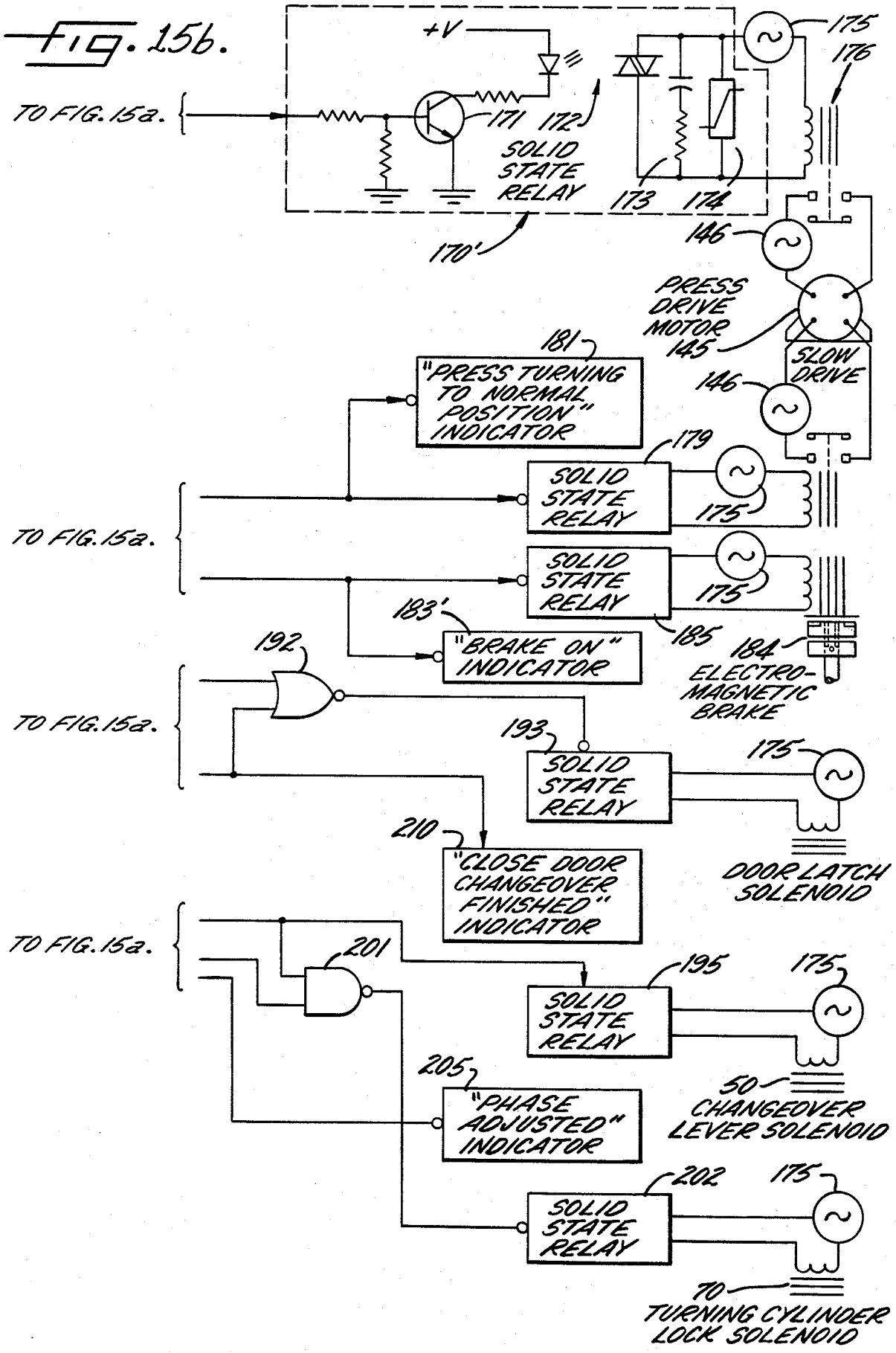
FIG. 15b.
+V
TO FIG. 15a.
171
172
SOLID STATE RELAY
173
174
170'
175
176
146
PRESS DRIVE MOTOR 145
SLOW DRIVE
146
181
"PRESS TURNING TO NORMAL POSITION" INDICATOR
179
SOLID STATE RELAY
175
TO FIG. 15a.
SOLID STATE RELAY
175
183'
"BRAKE ON" INDICATOR
185
184
ELECTRO-MAGNETIC BRAKE
192
TO FIG. 15a.
193
SOLID STATE RELAY
175
DOOR LATCH SOLENOID
210
"CLOSE DOOR CHANGEOVER FINISHED" INDICATOR
TO FIG. 15a.
201
195
SOLID STATE RELAY
175
50
CHANGEOVER LEVER SOLENOID
205
"PHASE ADJUSTED" INDICATOR
202
SOLID STATE RELAY
175
70
TURNING CYLINDER LOCK SOLENOID

CHANGEOVER PROTECTION SYSTEM FOR PERFECTING PRINTING MACHINES

FIELD OF THE INVENTION

The invention relates to sheet-fed rotary printing presses having a storage cylinder, a turning cylinder, and means for changing the storage cylinder and turning cylinder from a first form printing mode to a perfecting mode and vice versa.

BACKGROUND OF THE INVENTION

In a convertible perfecting printing press, the sheet to be printed is transferred between a first and second individual printing unit via a storage cylinder having twice the normal diameter and a turning cylinder. Means are provided for converting the storage cylinder and turning cylinder from a first form or a single-sided printing mode to a perfecting or double-sided printing mode, and means are also provided to accommodate different format sizes of the printed sheets. For perfecting, the sheet to be printed is guided by the storage cylinder with the leading edge of the sheet conveyed passed the tangential point between the storage cylinder of double diameter and the subsequent turning cylinder. As soon as the trailing edge of the sheet, which is held by a suction or calendering means, reaches the tangential point, it is gripped by turning grippers of the turning cylinder. The release of the leading edge of the sheet from the storage cylinder grippers occurs at the same time and the sheet is transferred with its originally trailing edge in leading position to the second printing unit.

Changeover of the storage cylinder and the turning cylinder from perfecting to first form printing or vice versa requires adjustment of the relative phase between the cylinders and also adjustment of the cams which control operation of the storage cylinder grippers and the turning grippers. Changeover is further complicated by adjustment of the printing format since the phase between the storage cylinder and the turning cylinder for perfecting is dependent upon the format adjustment. Due to these multiple adjustments, the changeover operation is highly complex and must be performed reliably if faulty printing, mistakes in sheet conveyance and damage to the printing press are to be avoided. Design of the changeover mechanism has been given considerable attention as is evident from Becker U.S. Pat. No. 4,014,261 issued Mar. 29, 1977. Moreover, interlocks have been provided so that the printing press can be cleared for operation only after completion of changeover and only after all the changeover steps have been carried out correctly.

A known interlock system for a changeover mechanism is disclosed in West German Pat. No. 2,620,392 and uses electromechanical devices. During adjustment of the phase between the storage cylinder and the turning cylinder, the turning cylinder is prevented from being turned by a locking lever engaging in a locking pin on the turning cylinder drive wheel. Adjustment of the cam follower rollers of the turning grippers is sensed by limit switches being abutted in the end positions. Adjustment of the storage cylinder cams is controlled simultaneously with rotation of the storage cylinder by a toothed segment whose rotation is secured electromechanically and in dependence upon gripper control. Limit switches are provided for detecting the position of the turning and storage cylinder gripper controls and for detecting actuation of the adjusting means and for securing the turning cylinder in rotation, and these limit switches are connected in series and logical AND-relationship to interrupt the power supply to the printing machine in the absence of coincidence.

The electromechanical interlock system disclosed in West German Pat. No. 2,620,392 has several disadvantages in its association of the various mechanical means to detect adjustment positions. The storage cylinder cam must be adjusted by a complete cam disk rather than a toothed segment in order to provide sensing surfaces for the necessary limit switch. Lever mechanisms are needed to protect the turning cylinder and its gripper control. More importantly, access to the changeover means is not adequately protected to prevent adjusting operations from being carried out unchecked and at inappropriate times. There is no way to ensure that the printing units are properly coupled after changeover and the gearing is reengaged, especially when the storage cylinder has been adjusted for a new printing format.

SUMMARY OF THE INVENTION

The primary object of the invention is to guarantee that changeover from first form printing to perfecting and vice versa is carried out properly under all conditions.

Another object of the invention is to provide increased safety to the printing machine operator.

Yet another object of the invention is to provide a changeover mechanism with adjusting devices that are readily accessible to the printing machine operator from outside of the machine frame.

Moreover, an object of the invention is to provide means for indicating to the printing machine operator the proper sequence for carrying out the changeover operation.

According to an important aspect of the invention, electrical circuit elements are provided to prevent access to the changeover means unless the press is in a normal position; electrical circuit means detect incomplete clamping of the storage cylinder and turning cylinder to inhibit operation of the press; further electrical circuit means are provided to protect adjustment of the grippers of the storage cylinder relative to the transfer position in the first form printing mode and of the calendering means relative to the transfer position in the perfecting mode; and the electrical circuit means are so interconnected that, upon completion of changeover, operation of the press is permitted only when the storage cylinder and turning cylinder have been correctly adjusted and locked.

In accordance with another important aspect of the present invention, contactless proximity switches detect a predetermined normal position of the turning cylinder, the corresponding first form printing position of the storage cylinder, the corresponding perfecting position of the calendering means, and the clamping of the position of the calendering means with respect to the storage cylinder. Moreover, the clamping of the gear train and the changeover of the means controlling the turning cylinder grippers are protected by limit switches and spring-loaded latches unlockable by electromagnetic solenoids. The changeover means are closeable by a door or flap. Subsequent printing is inhibited unless the door is closed, and the adjustment operation may be performed only when the door is open. The door is locked in either its opened or closed position by a spring-loaded latch unlockable by an electromagnetic solenoid. Preferably, the solenoid is energized to permit opening of the door only when the press has been stopped in its predetermined normal position, and the solenoid is energized to permit closing of the door only when the changeover means have been locked in either the first form printing position or the perfecting position as indicated by the contactless proximity switches.

The door or flap prevents unauthorized tampering with the changeover means while the press is in operation and it also ensures that the changeover operation starts at a predetermined initial state of the printing machine and subsequent printing is enabled only when changeover has been properly completed. The contactless proximity switches detect the positions of the turning cylinder and the storage cylinder making it unnecessary, for instance, to use mechanical aids which act on the press gearing. Therefore, the printing machine can be brought to its predetermined normal state at the start of the changeover operation by automatic or remote control. Changeover protection is further enhanced by the spring-loaded latches unlockable by electromagnets; consequently, neither the door or flap nor the clamping of the turning cylinder gearing nor the lever for changing over the turning cylinder cam can be operated while the press is printing. Interconnection of the various limits switches, proximity switches, and electromagnets insures that all the steps necessary for changeover are carried out completely. The calendering means, for example, are adjusted accurately on the storage cylinder in proper relation to the turning grippers.

In accordance with another feature of the present invention, optical indications are provided to signal correct adjustment and the steps in the adjustment procedure. The press operator can see immediately on an indicator array or display panel the necessary steps of the changeover procedure and any conditions which indicate an incorrect adjustment or operating state.

BRIEF DESCRIPTION OF THE DRAWINGS

Other objects and advantages of the invention will become apparent upon reading the following detailed description and upon reference to the drawings in which:

FIG. 15 is a schematic wiring diagram of a particular embodiment of the changeover protection system.

Figure 1:
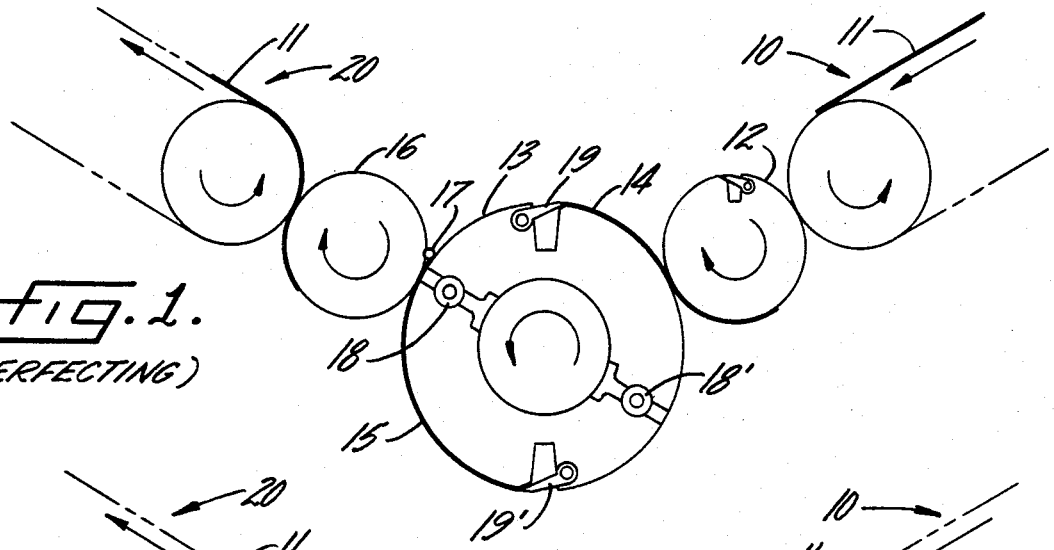
FIG. 1 is a schematic diagram of a storage cylinder and a turning cylinder showing the turning grippers gripping the trailing edge of a sheet during perfecting.

While the invention is susceptible to various modifications and alternative forms, a specific embodiment thereof has been shown by way of example in the drawings, and will herein be described in detail. It should be understood, however, that it is not intended to limit the invention to the particular form disclosed, but, on the contrary, the intention is to cover all modifications, equivalents, and alternatives falling within the spirit and scope of the invention as defined by the appended claims.

DESCRIPTION OF A PREFERRED EMBODIMENT

Turning now to the drawings, there is shown in FIG. 1 a schematic diagram of a first printing unit generally designated 10 feeding individual sheets 11 to a transfer drum 12 which in turn feeds the sheets to a storage drum 13. During perfecting, the sheets 11 are printed on both sides and consequently the sheets 11 must be turned over at some point in the printing process. For this purpose, the storage cylinder 13 has twice the normal diameter so that it may receive a sheet 14 at the same time that a previous sheet 15 is being turned over. The sheet 15 is turned over by a turning cylinder 16 having turning grippers 17 which can grip the trailing edge of the sheet 15 and then swing counterclockwise to flip the sheet 15 so that its trailing edge on the storage cylinder 13 becomes the leading edge on the turning cylinder. Calendering means or suckers 18, 18' are provided to hold the trailing edge portion of the sheet 15 to be gripped by the turning grippers 17. The storage cylinder 13 also has conventional grippers 19, 19' for gripping the leading edge portion of the sheets 14, 15. The grippers 19, 19' are closed and opened in the conventional fashion by cams. The cam releasing the gripper 19', for example, is adjusted in accordance with the format or length of the sheet 15. When the sheet 15 is gripped by the turning grippers 17 and the gripper 19 releases, the sheet is flipped over and fed to a second printing unit generally designated 20.

Figure 2:
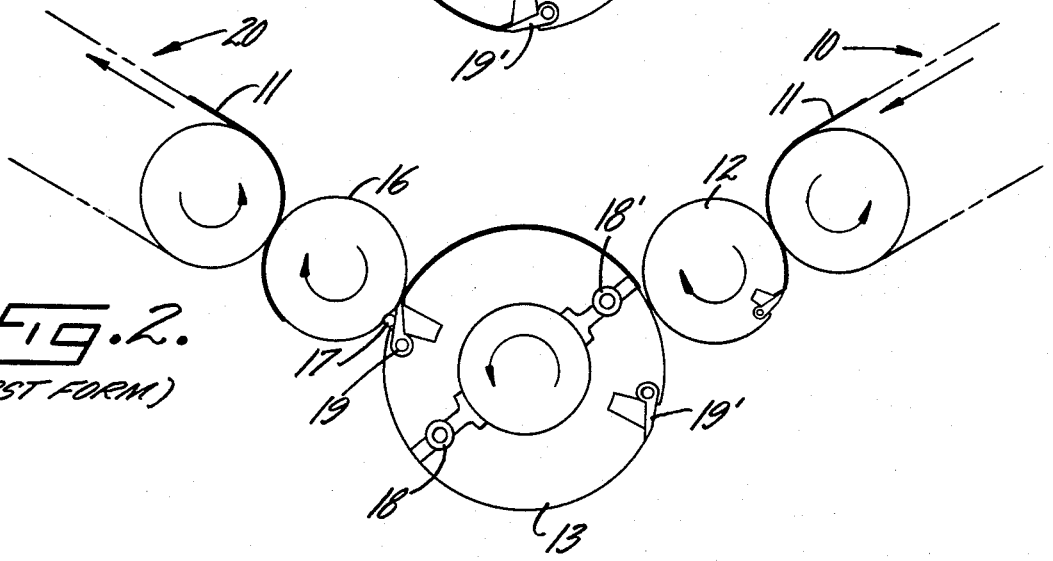
FIG. 2 is a schematic diagram of the storage cylinder and turning cylinder showing the turning grippers gripping the leading edge of a sheet during first form printing.

It is desirable that the perfecting mechanism in FIG. 1 may be changed over to permit first form printing or printing on a single side of the sheets 11. Then passage of the sheets 11 from the storage cylinder 14 to the turning cylinder 16 is as shown in FIG. 2. The cams operating the turning grippers 17 are switched over so that the turning grippers grip the leading edge of the sheet 14 on the storage cylinder 13. The turning grippers 17 operate as conventional grippers in this case. It is important to note, however, that the phase between the storage cylinder 13 and the turning cylinder 16 must be changed with respect to the phase relationship for perfecting since the storage cylinder grippers 19, 19' must coincide with the turning grippers 17 in the case of first form printing, but the calendering means 18, 18' must register with the turning grippers 17 for perfecting. This phase change is in addition to the required change in the cams for opening the storage cylinder grippers 19, 19'. Moreover, the relative phase between the storage cylinder 13 and the turning cylinder 16 for perfecting is dependent upon the format or length of the printed sheets 11. Thus, in general there are at least four adjustments required for changeover from perfecting to first form printing and vice versa, including adjustment of the turning gripper cams, adjustment of the relative phase between the turning cylinder 16 and the storage cylinder 13, adjustment of the calendering means 18 relative to the storage cylinder 13, and adjustment of the storage cylinder gripper cams.

Figure 3:
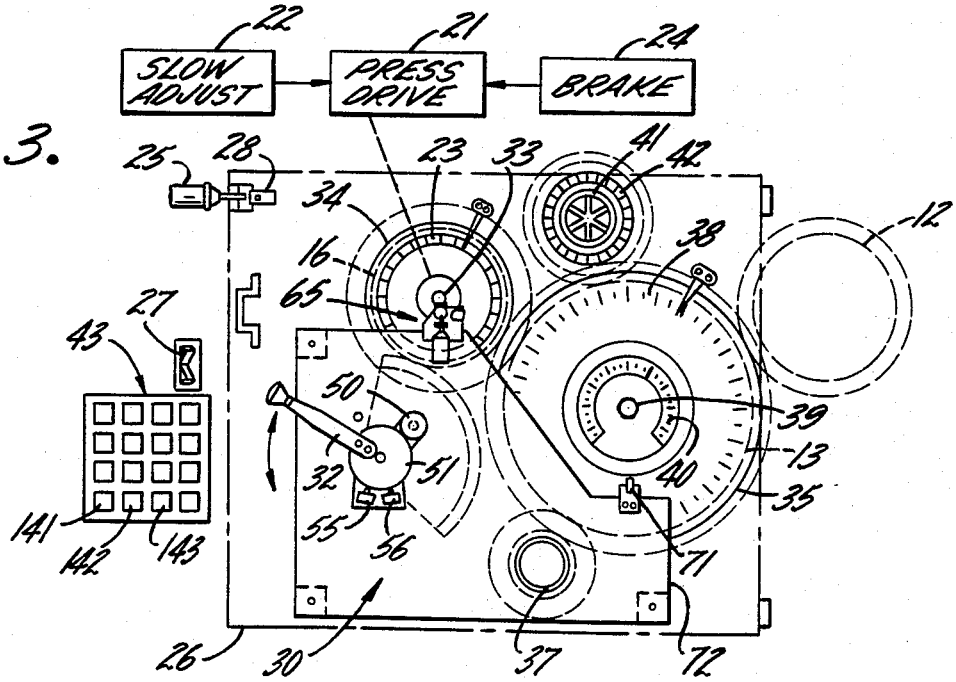
FIG. 3 is a pictorial diagram of the changeover means and protection system according to an exemplary embodiment of the present invention.

Turning now to FIG. 3 there is shown a pictorial diagram of an exemplary changeover protection system according to the present invention adapted to a type "RZK2—0/1/1E" multi-color perfecting printing press manufactured and sold by M.A.N.-Roland Druckmaschinen AG, 6050 Offenbach am Main, Christian-Pless-Strasse 6-30, Postfach 529 und 541, West Germany. A press drive 21 rotates the cylinders 12, 13, 16 during printing via a series of drive gears mounted on the journals of the cylinders and located externally to the main frame of the printing machine. Gears for adjustment of the gripper cams are provided inside the machine frame (see FIG. 11). At the beginning of the changeover operation, the press drive 21 is slowly adjusted by means 22 until a predetermined normal position is obtained, for example, when the turning grippers 17 are top dead center on the turning cylinder 16. The angular position of the turning cylinder 16 with respect to the machine frame is indicated, for example, by a scale 23 on the drive gear of the turning cylinder 16. When this predetermined normal position is obtained, a brake 24 is activated to prevent rotation of the press drive 21 and the turning cylinder 16. Once the press drive 21 has stopped and the brake 24 is applied, an electromagnet or solenoid 25 releases a spring-loaded latch to permit the opening of a door or flap 26 preventing tampering of the changeover mechanism when printing is being performed. The press operator requests a changeover operation by throwing an external switch 27 which causes shut down of the press drive 21 and subsequent slow adjustment and braking to obtain the predetermined normal position.

Once the operator opens the door 26, operation of the press drive 21 is inhibited by a limit switch 28 sensing whether the door 26 is locked and the solenoid 25 is deenergized. The door 26 cannot be closed thereafter to permit subsequent printing unless the solenoid 25 is reenergized which will occur only if the changeover from perfecting to first form printing or vice versa is complete and the adjustments have been locked. The door or flap 26, in other words, performs the dual functions of preventing access to the changeover means unless printing by the printing machine is stopped, and also comprises means for preventing subsequent printing until the changeover operation is complete.

Figure 6:
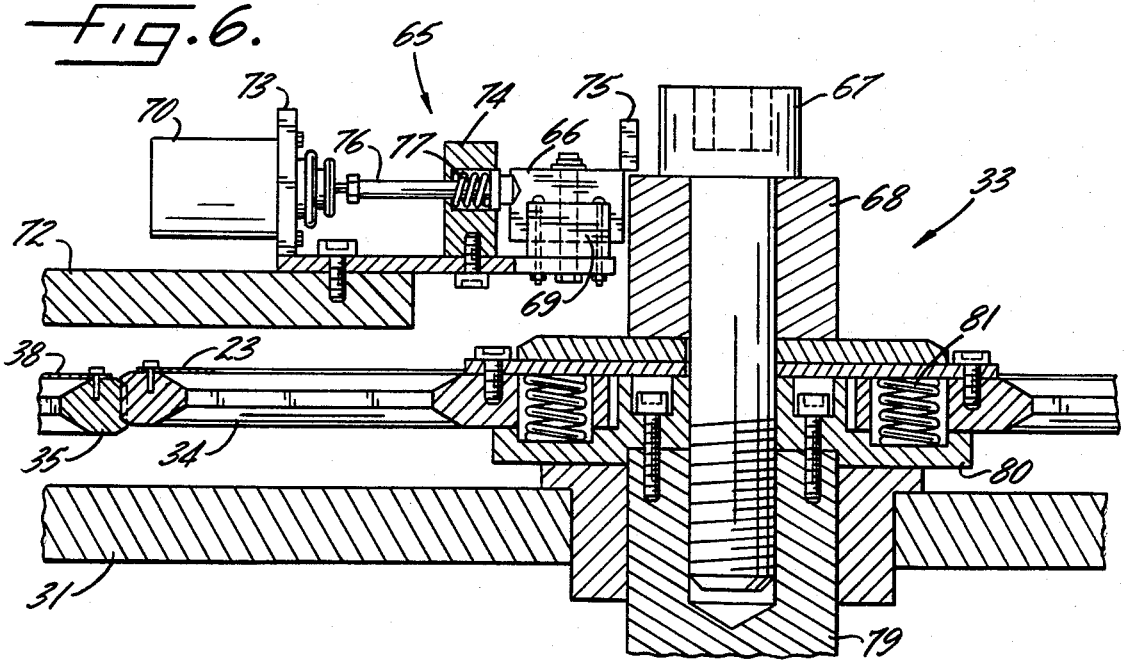
FIG. 6 is a side view and partial section of the means for locking the relative phase between the turning cylinder and the storage cylinder.
Figure 11:
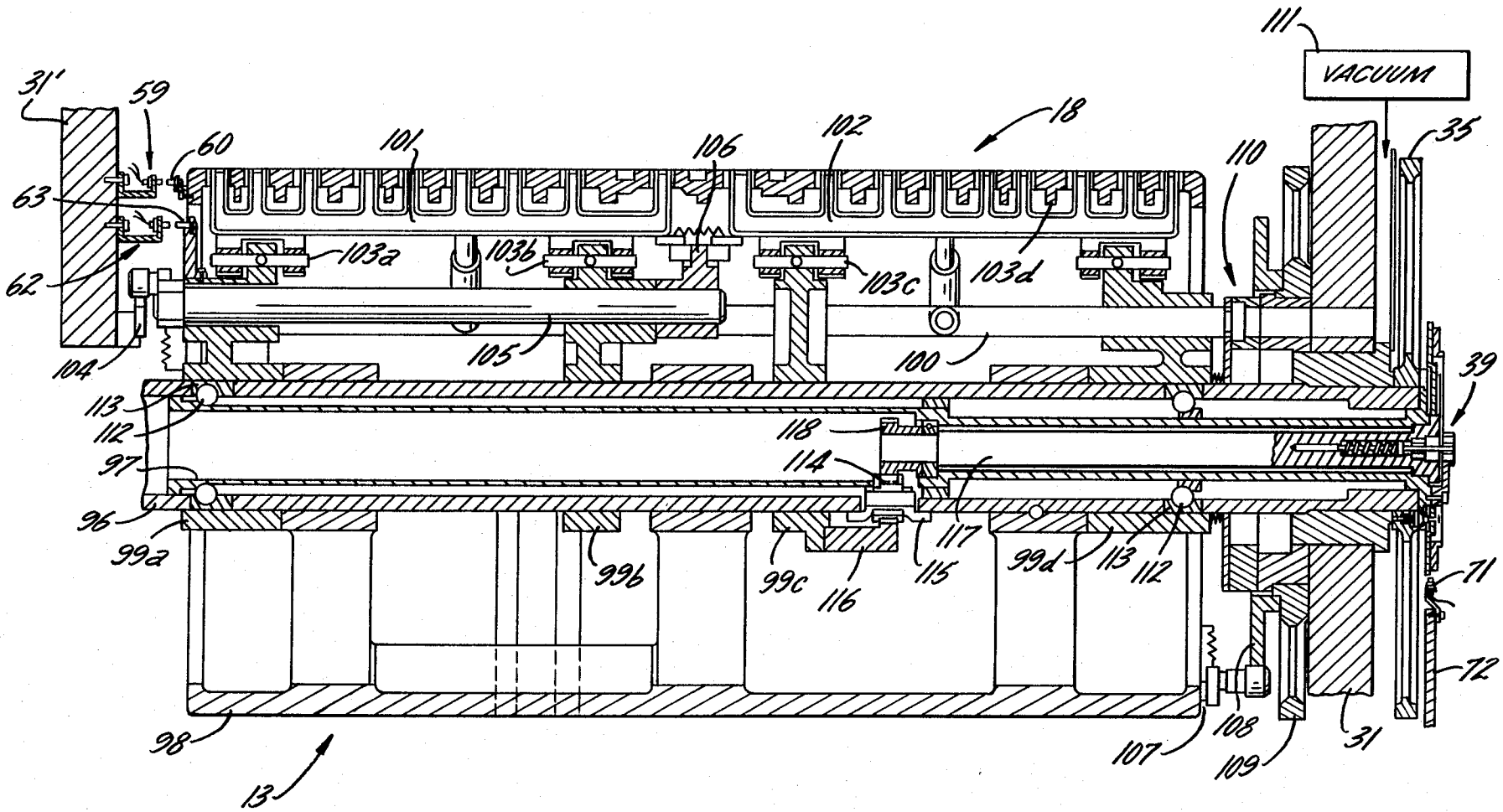
FIG. 11 is an axial or longitudinal crosssection of the storage cylinder showing the contactless proximity switches for detecting the relative angular position of the calendering means and the storage cylinder grippers with respect to the machine frame and also showing the means for adjusting and clamping the angular position of the calendering means with respect to the storage cylinder.
Figure 12:
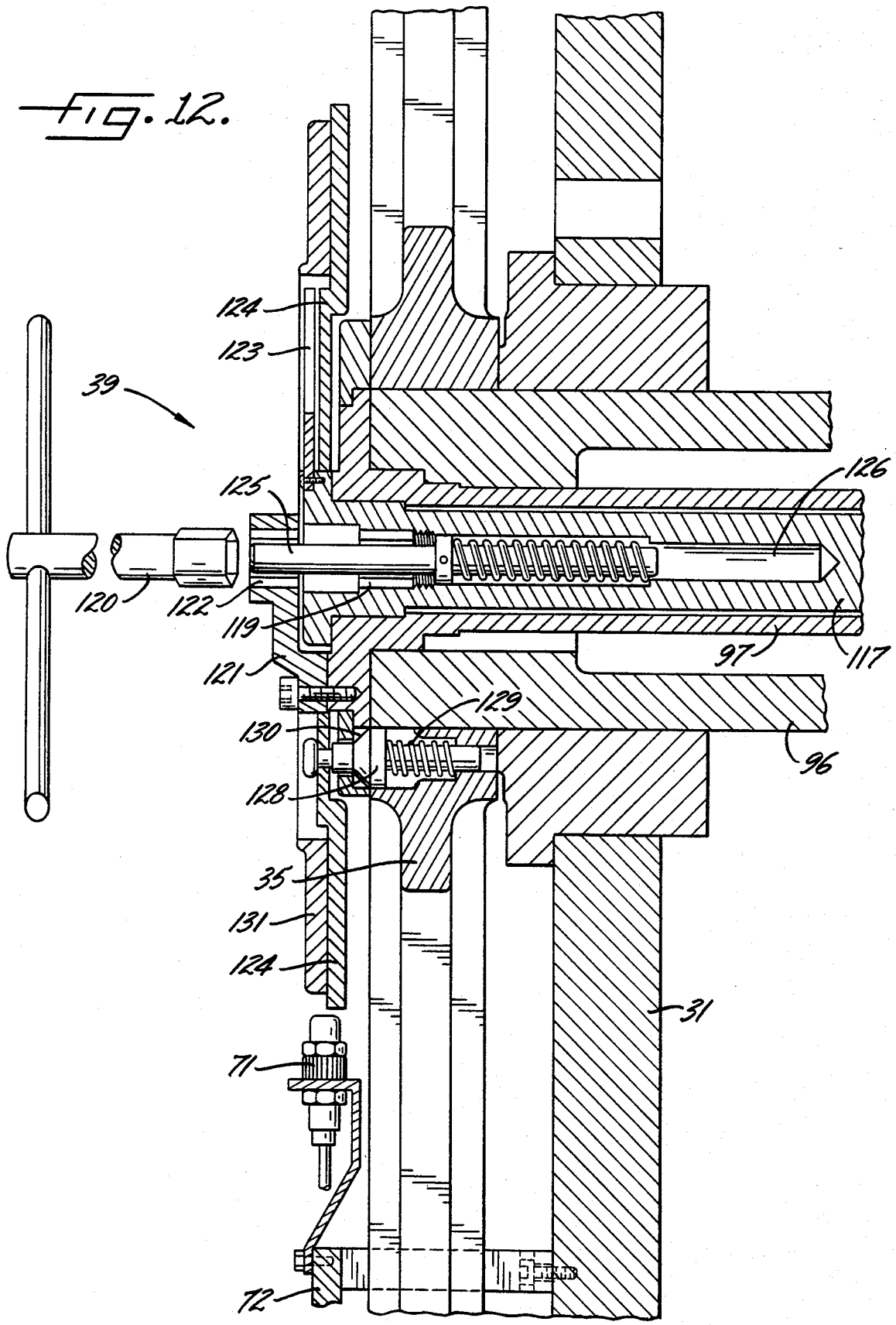
FIG. 12 is a detail of the contactless sensor for determining clamping of the angular position of the calendering means and further illustrating the adjustment of the calendering means for format.

The changeover means generally designated 30 are manipulated from outside of the press frame (31 in FIGS. 6, 11 and 12). To switch the cams of the turning cylinder 16 so that the turning grippers 17 will grip either the leading or trailing edge of the sheet 15, a changeover lever 32 rotates the turning cylinder cams from a predetermined perfecting position to a predetermined first form position. To adjust the relative phase between the turning cylinder 16 and the storage cylinder 13, a clamping mechanism 33 is loosened to disengage the drive gear 34 of the turning cylinder from the drive gear 35 of the storage cylinder (see FIG. 6). The transfer cylinder 13 is then rotated by a hand pulley 37 until the storage cylinder is at a predetermined angular position with respect to the machine frame for the case of first form printing, or is at an angular position depending upon the format or lengths of the printed sheets 11, in the case of perfecting, as indicated on a scale 38 on the drive gear 35 of the storage cylinder 13. Once the relative phase is obtained, the clamping mechanism 33 may be tightened to lock the phase adjustment. To adjust for the format or length of the printed sheets 11, the storage cylinder 13 is provided with an internal clamping and format adjusting mechanism which is adjusted externally at the end portion 39 of the storage cylinder journal (see FIG. 12). The selected format is indicated by a scale 40. Finally, the storage cylinder gripper cams are adjusted by a hand wheel 41 in accordance with the selected format indicated on an associated format scale 42.

In accordance with an important feature of the present invention, the changeover protection system includes an array of optical indicators 43 indicating the sequence of the adjustments to be performed. The door 26 cannot be closed to enable subsequent printing unless all of the indicated adjustments are properly performed.

Figure 4:
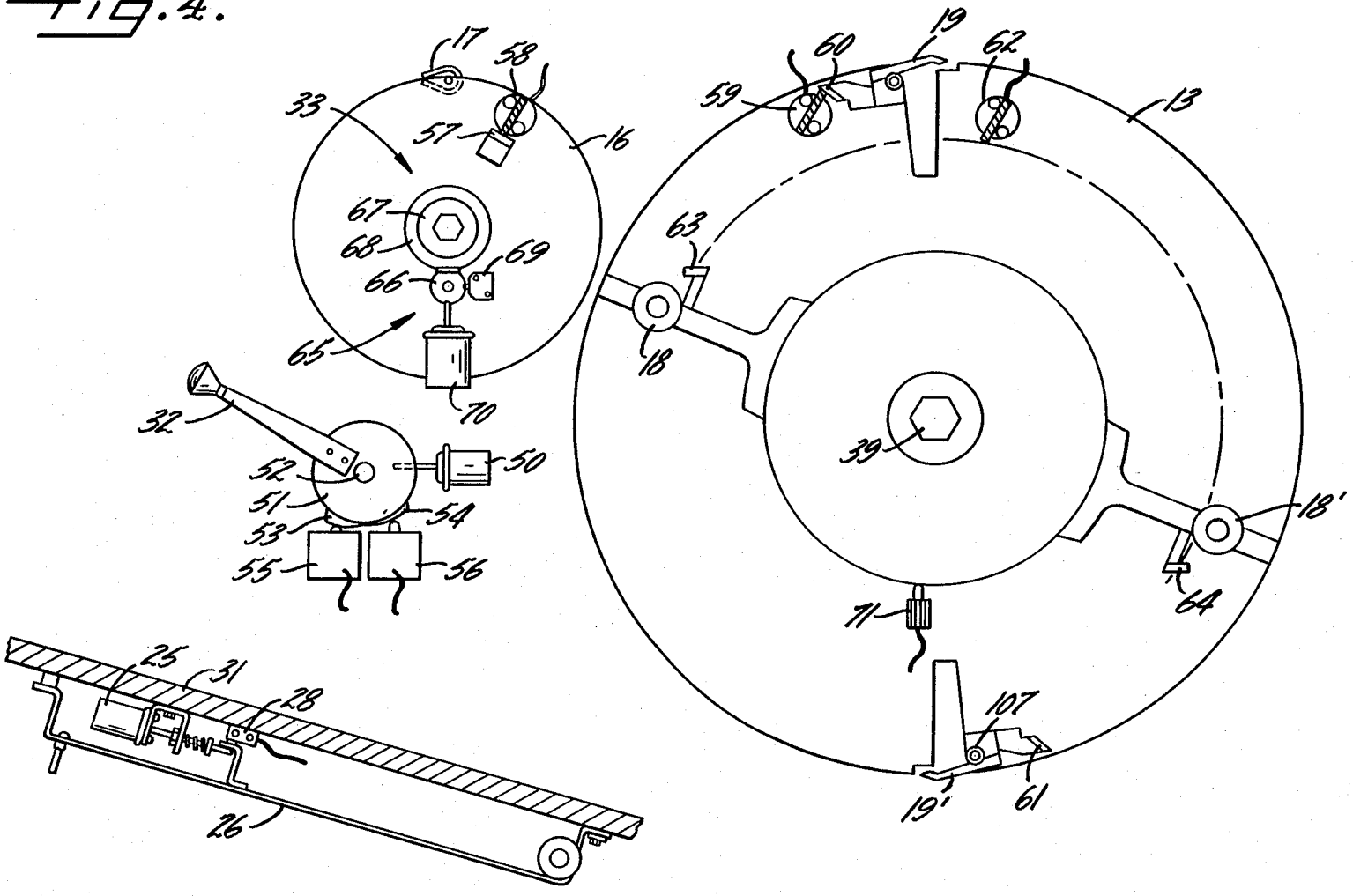
FIG. 4 is a schematic diagram showing the sensors and spring-loaded latches in the changeover protection system of FIG. 3.

To determine whether all of the required adjustments have been properly performed, and also to prevent certain adjustments from being taken out of adjustment, the changeover protection system includes numerous sensors and spring-loaded solenoid releasable latches. The sensors and latches are shown in FIG. 4. The door latch solenoid 25 and limit switch 28 sensing locking of the door 26 are mounted to the machine frame 31. The changeover lever 32 for the turning cylinder cams has a spring-loaded solenoid 50 engaging the hub 51 of the turning cylinder cam selector shaft 52. The hub 51 also has respective cams 53 and 54 for activating respective limit switches 55 and 56 indicating the perfecting and first form printing positions for the changeover lever 32.

For detecting the normal position of the turning cylinder 16, a tag 57 is fixed to the turning cylinder and is sensed by a contactless proximity switch 58 mounted on the press frame. The tag 57, for example, is a magnet and the proximity switch 58 is a solid-state digital Hall effect device Part No. 103SR5A-1 manufactured and sold by Micro Switch, a division of Honeywell, Freeport, Ill. 61032. This particular Hall effect device has an internal regulator, Schmitt trigger, and digital output compatible with standard digital logic components, as shown in FIG. 15. The limit switches may also be Hall effect switches such as Micro Switch Part No. 37XL31-02.

To determine the positions of the storage cylinder grippers 19, 19' for the case of first form printing corresponding to the normal position of the turning cylinder 16, a contactless proximity switch 59 mounted on the press frame senses tags 60 and 61 mounted on the shell of the storage cylinder 13 and which register with the proximity switch 59 at the proper positions. The positions of the storage cylinder 13 and turning cylinder 16 correspond to the case of the turning cylinder 16 being in its normal position and the storage cylinder 13 being in its corresponding position for first form printing. In order to detect the corresponding position of the storage cylinder 13 for the case of perfecting, another proximity switch 62 is mounted on the press frame to sense the registering positions of tags 63, 64 mounted on the calendering means 18 and 18', respectively.

For protecting the mechanism 33 for adjusting the relative phase between the storage cylinder 13 and the turning cylinder 16, a locking mechanism generally designated 65 has a protection disk 66 blocking disengagement of a spring-loaded clamping disk 68 (see FIG. 6). The clamping disk 68 can be disengaged only when the protection disk 66 is rotated. Rotation of the protection disk 66 is sensed by a limit switch 69 and rotation is normally locked by a spring-loaded solenoid 70 unless the changeover protection system energizes the solenoid.

To detect locking of the format adjustment 39, an inductive type proximity switch 71 senses the state of a specially designed clamping device further described below in connection with FIGS. 11, 12, and 13. The inductive type proximity switch detects the presence or absence of metallic or ferromagnetic material and includes, for example, a primary coil excited by a signal generator, a signal detector receiving the output of a secondary coil, and a Schmitt trigger. The presence or absence of the ferromagnetic material increases or decreases the flux linkage between the primary and secondary coils resulting in a responsive digital state at the output of the Schmitt trigger. Inductive type proximity sensors can also respond to non-ferrous metals by the dampening of the signal in the primary and secondary coils. The metal detecting proximity probes as well as associated circuitry are staple items of commerce available from many manufactures, including EDR Electronics, Inc., 2285 Mt. Prospect Road, Des Planes, Ill. 60018.

Since the protection device 65 associated with the turning cylinder 16 and the inductive type proximity sensor 71 associated with the storage cylinder 13 are mounted on opposite sides of the drive gears 34, 35 from the cylinders, a subframe 72 (FIG. 3) is mounted parallel to the main frame 31 to provide support for the protection device 65 and proximity sensor 71.

Figure 5:
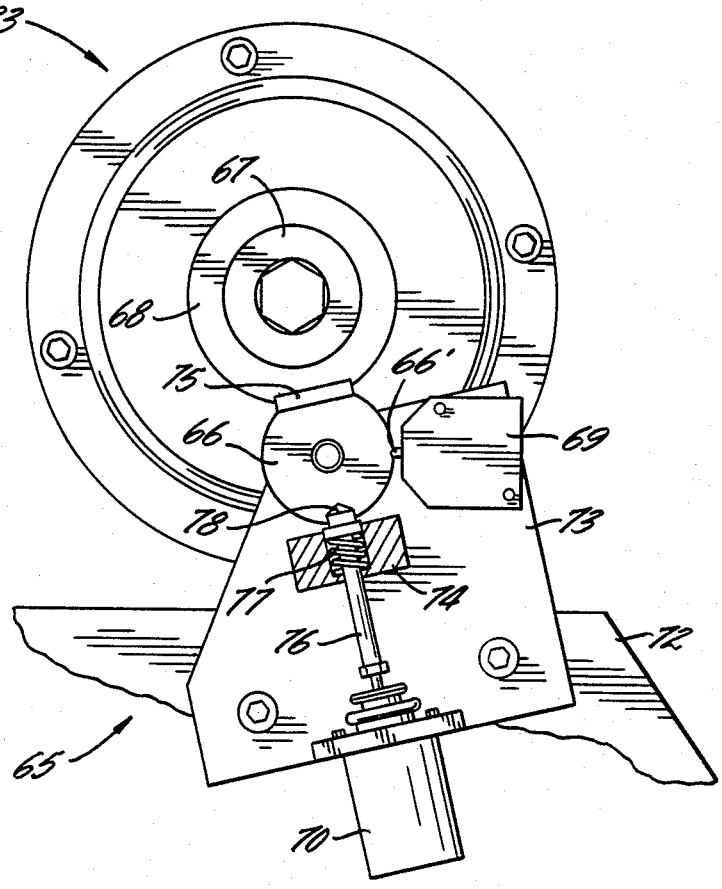
FIG. 5 is an elevation view of means for locking the adjustment of the relative phase between the turning cylinder and the storage cylinder.

Detailed views of the clamping mechanism 33 and the protection device 65 are shown in FIGS. 5 and 6. The protection disk 66 is mounted for rotation on a bracket 73 attached to the subframe 72. The bracket 73 also mounts the limit switch 69, the solenoid 70, and a guide and spring holder 74. The protection disk 66 captivates the clamping disk 68 by means of a tab 75 which is manipulated by the machine operator to permit the unclamping of the disk 68. The limit switch 69 cooperates with a detent 66' in the protection disk 66 to detect the locking position of the protection disk. If the solenoid 70 is not energized, a locking pin 76 screwed to the armature of the solenoid 70 is urged by a spring 77 into a bore 78 in the protection disk 66.

It is evident in FIG. 6 that so long as the tab 75 captivates the clamping disk 68, the drive gear 34 of the turning cylinder will be engaged with the drive gear 35 of the storage cylinder. The drive gear 34 for the turning cylinder is mounted for axial movement with respect to the journal 79 of the turning cylinder. A splined hub 80 engages with an inner gear defined on the drive gear 34 so as to preserve the phase relation between the drive gear 34 and the turning cylinder journal 79. The axial movement of the drive gear 34 with respect to the turning cylinder journal 79 provides disengagement of the turning cylinder drive gear 34 from the storage cylinder drive gear 35. To perform the relative phase adjustment between the storage cylinder 13 and the turning cylinder 16, the machine operator, after rotation of the protection disk 66, loosens the screw 67 and the clamping disk 68 is permitted to move outward axially as urged by the force of springs 81 tending to move the turning cylinder drive gear 34 axially away from the turning cylinder 79 until the drive gears 34 and 35 disengage. The screw 67 is tightened to reengage the drive gears 34 and 35 after the storage cylinder 13 has been rotated by hand to the proper relative phase. The machine operator can rotate the protection disk 66 to its locking position only after the screw 67 is tightened and the drive gears 34 and 35 reengage. Thus, the limit switch 69 senses positive locking of the means for relatively adjusting the phase of the storage cylinder 13 relative to the turning cylinder 16.

Figure 9:
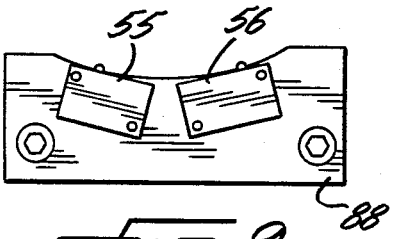
FIG. 9 is a plan view of the dual limit switches in FIG. 7.
Figure 8:
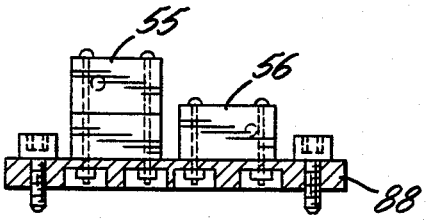
FIG. 8 is an elevation view of the dual limit switches of FIG. 7.
Figure 7:
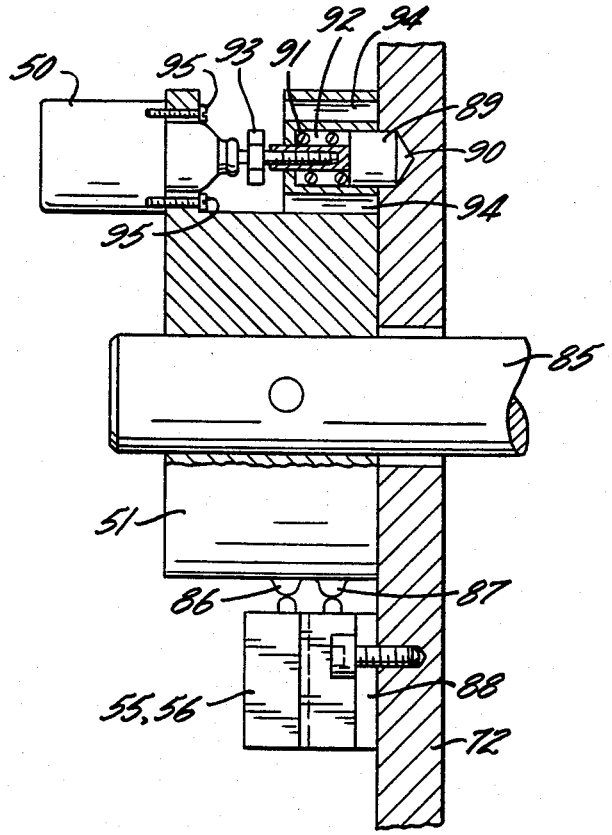
FIG. 7 shows the locking mechanism and limit switches for the changeover of the turning cylinder cams.

FIG. 7 shows in greater detail the protection of the turning cylinder cams. The hub 51 is pinned to a shaft 85 geared to the turning cylinder cams. The limit switches 55 and 56 are activated by angularly and axially displaced protusions 86, 87 respectively. Alternatively, detents in the hub 51 may be used in lieu of the protrusions 86, 87. The limit switches 55, 56 are mounted on a plate 88 shown in greater detail in FIGS. 8 and 9.

FIG. 7 also shows in detail the mounting of the locking solenoid 50. The armature of the solenoid 50 is screwed to a locking pin 89 which engages with one of two bores 90 in the machine subframe 72 at the locking positions for perfecting and first form printing. The pin 89 is normally urged into the subframe 72 by a spring 91 recessed in a bore 92 in the hub 51. A jam nut 93 permits adjustment of the throw of the solenoid armature with respect to the throw of the pin 89. The hub 51 also has bores 94 providing access to machine screws 95 mounting the solenoid 50 to the hub 51.

Figure 10:
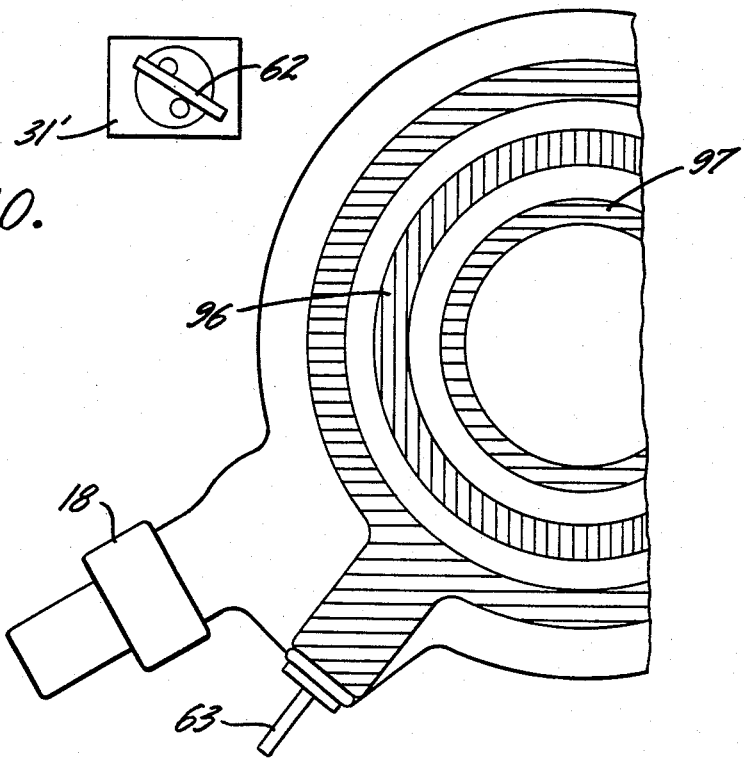
FIG. 10 is a schematic diagram showing the calendering means and the contactless proximity switch detecting the relative angular position of the calendering means.

Shown in FIG. 10 is a schematic diagram showing the mounting of the tag 63 to the calendering means 18 for registration with the contactless proximity switch 62 mounted on the machine frame 31'. The calendering means 18 is rotated relative to a hollow shaft 96 of the storage cylinder 13. The adjusted position of the calendering means 18 on the shaft 96 is locked by rotation of a hollow locking shaft 97 with respect to the hollow shaft 96 of the storage cylinder.

The details of construction of the storage cylinder 13 are shown in FIG. 11. The storage cylinder is defined by an outer shell 98 journaled on the hollow storage cylinder shaft 96. The calendering means 18 are also journaled to the hollow cylinder shaft 96 by a series of supports 99*a*, 99*b*, 99*c*, 99*d* which are fixed to each other via a vacuum or suction pipe 100. The tag 63 is attached to the sucker support 99*a*. The calendering means 18 has two interdigitated suckers 101 and 102 mounted to the supports 99*a*, 99*b*, 99*c*, 99*d* via diagonal guides 103*a*, 103*b*, 103*c*, 103*d*. Calendering or stretching of the sheet 15 (see FIG. 1) having its trailing edge gripped by the suckers 101, 102 is provided by a sheet stretching cam 104 actuating a swiveling shaft 105 to diagonally move the suckers 101, 102 when the suckers are forced apart axially by a swiveling cam 106. The gripper 19' holding the leading edge of the calendered sheet 15 (FIG. 1) is activated by rotation of a gripper shaft 107 driven by a gripper cam 108. The gripper cam 108 is rotatable by a gear 109 which engages a cooperating gear journaled to the adjusting wheel 41 (FIG. 3). Release of the trailing edge of the sheet during calendering is performed by a pneumatic commutator generally designated 110 which interrupts the flow of air from the suckers 101, 102 to a vacuum supply 111.

Of particular relevance to the present invention is the means for adjusting the position of the calendering means 18 and the means for locking the adjusted position. The means for locking the adjusted position comprise a right and left set of ball bearings 112 which are seated in resilient locking pads 113. The ball bearings 112 are also seated in inclined races on the outer periphery of the hollow locking shaft 97. When the hollow locking shaft 97 is rotated with respect to the storage cylinder shaft 96, the ball bearings 113 are pushed axially outward, due to the incline of the races, thereby forcing the locking pads 113 into locking engagement with the sucker supports **99*a* and 99*d***.

To effect angular rotation of the sucker supports **99*a*, 99*b*, 99*c*, 99*d* about the storage cylinder shaft 96, a pinion gear 114 is journaled to a support 115 in an aperture in the hollow shaft 96. The pinion 114 engages with an arcuate rack 116 fixed to the sucker support 99*c*. A format adjusting shaft 117 is journaled within the hollow locking shaft 97 and has a gear 118 affixed to its inner end which engages with the pinion 114. Therefore, when the locking shaft 97 is turned to permit rotation of the calendering means 18 with respect to the storage cylinder shell 98, rotation of the format adjusting shaft 117 effect rotation of the calendering means 18**.

Shown in FIG. 12 is a detail of the portion 39 of the format adjusting and locking means that are external to the press frame 31. To provide format adjustment, the central adjusting shaft 117 is provided with a key seat 119 for receiving a hex key 120. To provide adjustment of the locking shaft 97, a bridge 121 is bolted or welded to the shaft 97 and also has a key seat 122 for engagement with the hex key 120. During format adjustment, the hex key 120 is first placed in the first key seat 122 to unlock the format adjustment, and then the key 120 is pushed axially inward to the second key seat 119 to adjust the desired format. Once the desired format is adjust as indicated by a pointer 123 on a scale 124, the hex key 120 is displaced back to the first key seat 122 to lock the format adjustment. To insure that the hex key 120 is not inadvertently left in the adjustment mechanism 39 by the machine operator, a spring-loaded ejecter pin 125 is disposed centrally in a bore 126 in the adjusting shaft 117.

Figure 13:
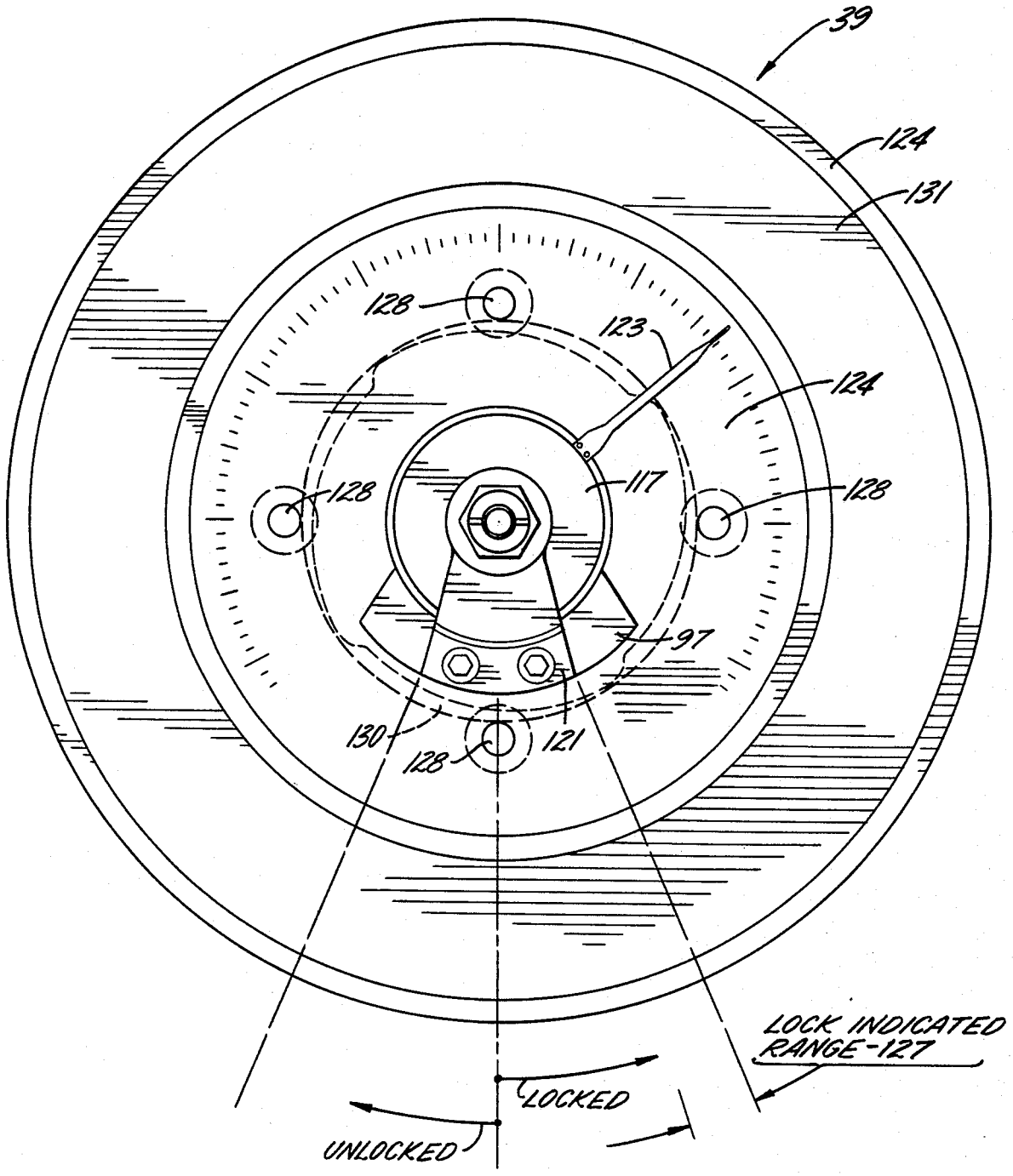
FIG. 13 is an end view of the format scale and the mechanism for sensing clamping of the calendering means.

As shown in FIG. 13, the locking shaft 97 and the bridge 121 have a limited predetermined range of angular displacement with respect to the hollow shaft 96 of the storage cylinder 13. This limited angular range is defined by the races formed on the outer periphery of the locking shaft 97 and holding the ball bearings 112 (see FIG. 11). Locking of the format adjustment is guaranteed at an extreme end of this range 127.

To provide an electrical indication of whether the format adjustment is locked, the format scale 124 is mounted for axial movement with respect to the storage cylinder 13 by way of spring-loaded pins 128 journaled in the drive gear 35 of the storage cylinder 13. Springs 129 urge the pins 128 against beveled actuating surfaces 130 formed in the outer periphery or flange on the hollow locking shaft 97. As is evident in FIG. 13, the beveled actuating surfaces act as a helical cam to translate rotation of the locking shaft 97 with respect to the storage cylinder 13 into axial displacement of the pins 128. When the format adjustment is locked by rotation of the locking shaft 97, the pins 128 are pushed axially inward thereby displacing the format scale 124 inward against the drive gear 35. This axial displacement is detected by the inductive type proximity switch 71. The format scale 124 is circular and attached to a circular bezel plate 131 for further rigidity. Thus, the proximity switch 71 will detect locking or unlocking of the clamping mechanism 39 regardless of rotation of the storage cylinder 13 with respect to the machine frame 31. An electrical indication is obtained without the need for slip rings to convey an electrical signal from the storage cylinder 13, and format adjustment and locking are easily controlled from a single location.

Changeover from first printing to perfecting proceeds as follows:

To initiate changeover, printing by the printing machine is stopped and locked by the selector switch 27 being thrown from a "run press" position to an "adjust press" position. The brake 24 of the press is released and the press is turned to its normal position as detected by the turning cylinder proximity switch 58. When the press is in its normal position an indicator 141 on the indicator array 43 is activated along with the door solenoid 25 so that the door 26 may be opened.

When the press operator opens the door 26, the limit switch 28 causes the door solenoid 25 to deenergize so that the door 26 cannot be closed until changeover has been completed. Also, the changeover lever solenoid 50 is energized to unlock the changeover lever 32 so that the turning cylinder cams may be switched over.

The press operator throws the changeover lever 32 from its first printing position to its perfecting position.

Next the relative phase between turning cylinder 16 and the storage cylinder 13 is adjusted. The solenoid 70 serving to lock the protection disk 66 is energized so that the machine operator may pivot away the protection disk to gain access to the screw 67 and clamping disk 68 to isolate the gearing between the turning cylinder 16 and the storage cylinder 13. By manipulating the pulley 37, the phase of the storage cylinder 13 is adjusted relative to the turning cylinder 16 until the proper format is indicated by the scale 38 on the storage cylinder drive gear 35 (see FIG. 3). The screw 69 is then tightened to reengage the gearing and the protection disk 66 is pivoted back to secure the clamping of the gearing. The limit switch 69 detects the pivoting back of the protection disk 66 and thus senses completion of the changeover.

Next the calendering means 18 is adjusted for format. By use of the two-position key 120 in conjunction with the format adjusting mechanism 39 (FIG. 12), the press operator releases clamping of the calendering means 18. The induction switch 71 senses the axial movement of the format scale 124. The two-position key 120 is moved to its inward position or key seat 119 and the format is adjusted. For the perfecting operation, the fine adjustment of the calendering means 18 is provided by the calendering proximity switch which activates an indicator 142 until the proper position is obtained. Then, the two-position key 120 is moved back to the first key seat 122 and the format adjustment is clamped as detected by the inductive proximity switch 71.

Finally, the press operator switches over the storage cylinder gripper cams by operating the hand wheel 41 (FIG. 3). It should be noted that adjustment of the cams for the storage cylinder grippers 19, 19' need not be protected since the transported sheet 14 (FIG. 1) is merely engaged too soon or too late, and no press damage occurs. The improper adjustment is readily detected by failure of the sheet feed and the gripper cams can be readily corrected subsequently. Once all of these adjustment have been performed, the selector switch 27 is thrown back to the "run press" position thereby energizing the door latch solenoid 25 to permit closing of the door 26. Closing of the door 26 is sensed by the door switch 28 enabling subsequent printing.

The adjustment procedure for changeover from perfecting to first form printing is substantially the same except the changeover lever 32 is thrown in the opposite direction and the phase between the storage cylinder 13 and the turning cylinder 16 is adjusted until the storage cylinder gripper proximity switch 59 indicates the first form position.

Figure 14:
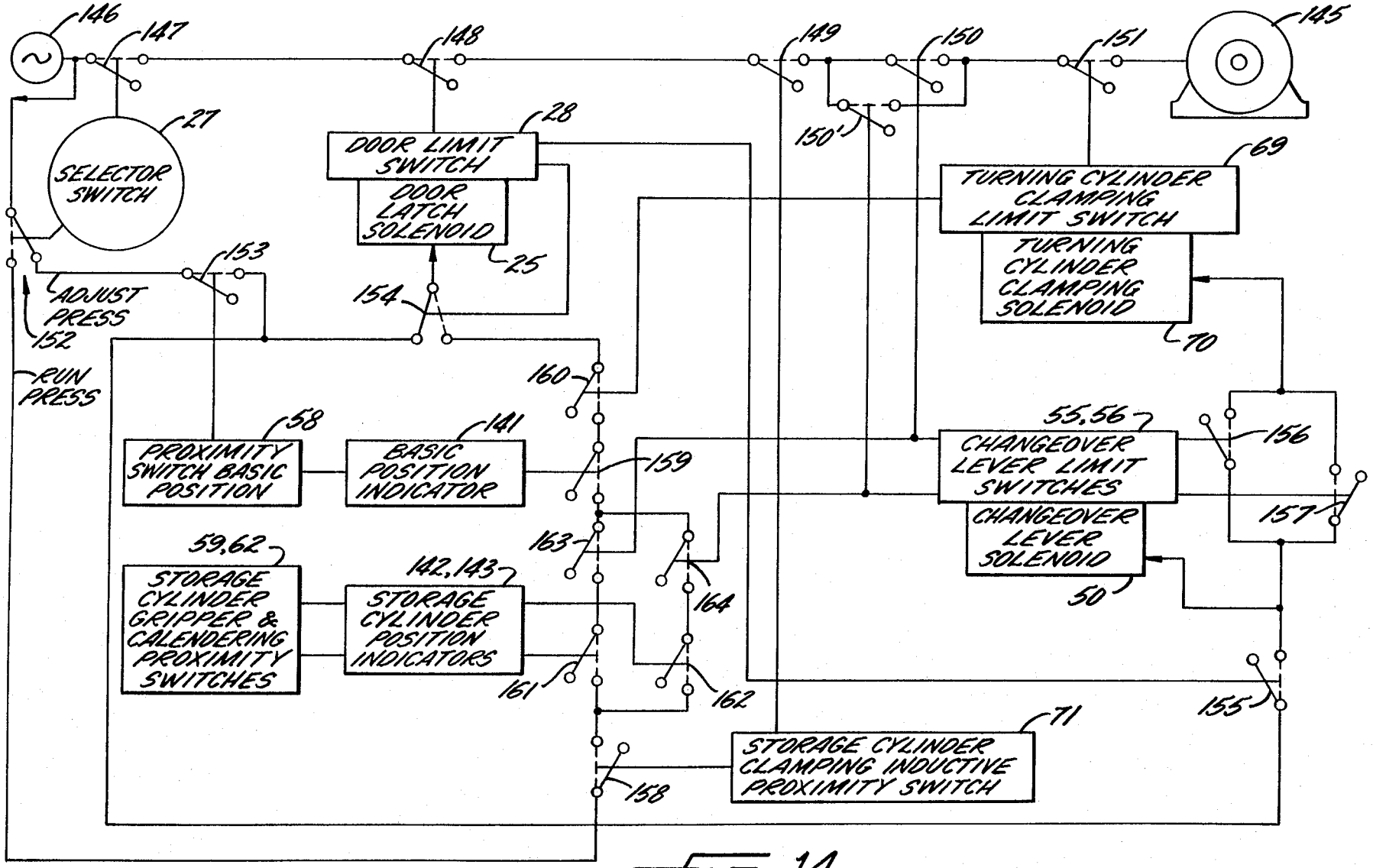
FIG. 14 is a functional block diagram showing the interconnection of the sensors, indicators and proximity switches in the changeover protection system.

Turning now to FIG. 14 there is shown a functional diagram of the control logic for the changeover protection system. At all times the drive motor 145 of the printing machine is isolated from the main power source 146 to stop printing unless the selector switch 27 is at the "run press" position, the door 26 is closed as indicated by the door latch limit switch 28, the storage cylinder 13 is clamped as indicated by the inductive proximity switch 71, the changeover lever 32 has been switched fully to either its perfecting or first form position as detected by the limit switches 55, 56, and the gearing has been clamped as indicated by the limit switch 69. In other words, the series connection between the press drive motor 145 and the main power source 146 is not closed unless all of these conditions are fulfilled as indicated by respective series switches 147, 148, 149, 150 or 151', and 151.

The changeover procedure starts when the selector switch 27 is switched over from the "run press" position to the "adjust press" position as indicated by the two-position switch 152. The printing machine is then turned to its basic position indicated by the turning cylinder proximity switch 58 thereby closing a switch 153 and energizing the door latch solenoid 25 until the door limit switch 28 toggles a switch 154 indicating that the door 26 is open. The door limit switch 28 also closes a switch 155 energizing the changeover lever solenoid 50 so that the changeover lever 32 may be switched from the perfecting position to the first form printing position and vice versa. Once the desired position of the changeover lever 32 is obtained, one of switches 156 or 157 closes thereby energizing the turning cylinder clamping solenoid 70 so that the phase may be adjusted between the storage cylinder 13 and the turning cylinder 16. Also adjustment of the proper phase is detected by one of the storage cylinder gripper or calendering proximity switches 59, 62 and indicated by respective storage cylinder position indicators 142 or 143.

Once the format for the storage cylinder 13 is adjusted and the turning cylinder 16 has been clamped, the selector switch 27 is switched to the run press position thereby toggling switch 152 and enabling a circuit to energize the door latch solenoid 25 so that the door may be closed. This door closing circuit comprises a switch 158 closed by the storage cylinder clamping inductive proximity switch 71, a switch 159 closed by the basic position proximity switch 58, and a switch 160 closed by the turning cylinder clamping limit switch 69. Also included in this door closing circuit are a pair of switches 161 and 162 closed by the storage cylinder gripper proximity switch 59 and the calendering proximity switch 62, respectively, and switches 163 and 164 closed by the first form indicating changeover limit switch 55 and the perfecting position changeover limit switch 56.

It should be noted that the switches 161 and 163 are in a parallel branch with respect to switches 162 and 164. in other words, if the changeover lever 32 selects first form printing, then the storage cylinder gripper proximity switch 59 must be closed in order for the door latch solenoid 25 to be energized to permit door closing, but if the changeover lever 32 selects perfecting, then the calendering means proximity switch 62 must be closed to energize the door latch solenoid for door closing.

It should also be noted that the toggle switch 152 controlled by the selector switch 27 is complementary to the toggle switch 154 controlled by the door limit switch 28. The selector switch 27, in other words, determines whether the changeover protection system is in a "door opening" or a "door closing" state. The two states must be defined for controlling the opening and the closing of the door 26 since the door latch solenoid 25 must be energized for both the opening and the closing of the door, and the state of the door limit switch 28 is insufficient in itself to determine whether the door latch solenoid 25 should be energized or deenergized. From the machine operator's point of view, the selector switch 27 must be toggled between door openings and door closings. The selector switch 27 must be thrown to the "adjust press" position in order to open the door 26, and it must be thrown back to the "run press" position before the door 26 is closed after adjustment.

It is evident from FIG. 4 that if the control logic is implemented directly by switches, the proximity and limit switches must have multiple pairs of contacts. Multiple pairs of contacts are not usually provided, however, with solid-state Hall effect switches. Therefore, the circuit shown in FIG. 15 is preferred. The Hall effect proximity switches are compatible with digital logic circuits such as 4000 series complementary MOS. Thus, instead of using a series of switches such as switches 147–151 to turn on the pressdrive motor 145, a multiple input NOR gate 170 (part number 4078) determines the coincidence of signals required to enable the press drive motor for printing. The low power output of the NOR gate 170 drives a solid-state relay 170' including a transistor 171, a light activated triac 172, a snubber network 173 comprising a capacitor in series with a resistor, and a surge limiting varistor 174. The solid-state relay 170' completes a circuit from an alternating voltage source 175 to a contactor 176 which selectively connects the press drive motor 145 to the power source 146.

When the selector switch 27 is thrown from the "run press" position to the "adjust press" position, an inverter 177 and a three input NAND gate 178 activates a solid-state relay 179 to energize a contactor 180 to slowly drive the press motor 145 until the normal position sensor or turning cylinder proximity switch 58 determines the normal position of the turning cylinder 16 as shown in FIG. 4. As the press drive motor 145 is slowly driven, an indicator 181 announces this fact on the indicator array 43 (FIG. 3). Once the normal position is found, the slow drive to the motor 145 is shut off and two two-input NOR gates 182, 183 energize an electromagnetic brake 184 via a solid-state relay 185. The NOR gate 183 insures that the brake is always on whenever the door 26 is unlocked. A "brake on" indicator 183' displays the fact that the brake 184 is on.

The indictors are comprised of driver transistors and incandescent lamps. A representative circuit is shown for an indicator 186 active when the door 26 is unlocked. The indicator 186 is comprised of pull-up resistors 187 and 188, a Darlington transistor pair 189, and an incandescent lamp 190. The pull-up resistors 187 and 188 interface directly to a current sinking type Hall effect door lock sensor. Alternatively, a mechanical limit switch may be used that closes a contact to ground when the door 26 is locked.

Once the electromagnetic brake 184 is applied, the turning cylinder 16 has been rotated to its normal position and the door 26 may be opened as detected by a three-input NOR gate 191. A two-input NOR gate 192 and a solid-state relay 193 energizes the door lock solenoid 25 so that the door pops open. When the door lock sensor 28 determines that the door is no longer locked, the door latch solenoid 25 is deenergized and a three input NOR gate 194 energizes the changeover lever solenoid 50 via a solid-state relay 195.

The selected position of the changeover selector lever 32 is detected by the sensors or limit switches 55 and 56 and indicated by a "perfecting selected" indicator 196 and a "first form selected" indicator 197. Two two-input NAND gates 198 and 199 determine whether the changeover lever 32 is ajar and indicates this fact on a "changeover lever ajar" indictor 200. The output of the NAND gate 199 is also used to inhibit printing when the changeover lever 32 is ajar. If the changeover lever is not ajar, a two input NAND gate 201 energizes the turning cylinder lock solenoid 70 via a solid-state relay 202.

During adjustment of the relative phase between the storage cylinder 13 and the turning cylinder 16, the first form storage gripper position is sensed by the proximity switch 59 indicated by a "first form position" indicator 203. Similarly, during adjustment of the calendering means 18 for perfecting, the calendering perfecting position is sensed by the contactless proximity switch 62 and indicted by a "calendering position" indicator 204. To activate a "phase adjusted" indicator 205, the series-parallel combination of switches 161-164 in FIG. 14 is implemented by three NOR gates 206, 207, and 208. Once the "phase adjusted" indicator 205 lights up, the machine operator clamps the turning cylinder adjustment with the protection disk 66 and clamps the calendering adjustment mechanism 39 and finally throws the selector switch 27 to the "run press" position in order to permit the door 26 to be closed. As soon as the selector switch 27 is thrown to the "run press" position after clamping and when the phase adjusted indicator 205 is activated, a multiple input NOR gate 209 energizes the door latch solenoid 25 and a "closed door changeover finished" indicator 210 is activated to tell the operator to close the door 26.

If during the adjustment procedure the phase cannot be adjusted or if the "closed door changeover finished" indicator will not light up, the indication array 43 should first be consulted to determine a possible cause of the difficulty. If the turning cylinder 16 has been jarred from its normal position when the door 26 is unlocked, a "abnormal position" indicator 211 will display this fact. Improper clamping of the calendering means is indicated by a "calendering means ajar" indicator 212. A "turning cylinder ajar" indicator 213 is also provided. Once these abnormal conditions are cleared, the machine operator can throw the selector switch 27 to the "run press" position and close the door 26 to resume subsequent printing.

In view of the above, a changeover protection system has been described that guarantees that changeover from first form printing to perfecting and vice versa is carried out properly under all conditions. The protection system provides increased safety to the printing machine operator yet at the same time provides a changeover mechanism with adjusting devices that are readily accessible from outside of the machine frame. The changeover protection system has an indicator array having numerous indicators that instruct the machine operator of the proper sequence for carrying out the changeover operation and also indicate abnormal conditions.

What is claimed is:

1. A changeover protection system for a sheetfed rotary printing machine having a storage cylinder with grippers and integral calendering means, a turning cylinder having turning grippers, a machine drive for rotating the cylinders, and means for changeover of the cylinders from a first printing mode to a perfecting mode and vice versa, said means for changeover including means for adjusting and locking the relative phase between the cylinders, means for adjusting and locking the relative angular position of the calendering means with respect to the storage cylinder grippers, and means for adjusting the turning grippers to selectively grip the leading or trailing edge of the sheet on the storage cylinder for first form printing or perfecting, said changeover protection system electrically blocking printing by the printing machine during adjustment of said means for changeover, said changeover protection system comprising, in combination, means for preventing access to said changeover means unless printing by the printing machine is stopped, first means for detecting locking of said means for adjusting the relative phase between the cylinders and inhibiting printing in the absence of said locking of the means for adjusting the relative phase, second means for detecting locking of said means for adjusting the relative angular position of the calendering means and inhibiting printing in the absence of said locking of the means for adjusting the relative angular position of the calendering means, and first electrical means responsive to the relative angular position of said turning grippers with respect to said calendering means when said turning grippers are adjusted for perfecting and inhibiting printing in the presence of substantial angular misalignment, and second electrical means responsive to the relative angular position of said turning grippers with respect to said storage cylinder grippers when said turning grippers are adjusted for first form printing and inhibiting printing in the presence of substantial angular misalignment, so that during printing mechanical interference of the turning grippers with the calendering means due to improper adjustment is prevented.

2. The system as claimed in claim 1, wherein said means for preventing access to said changeover means comprises means for preventing access to said changeover means unless the machine drive is in a predetermined angular position.

3. The system as claimed in claim 2, wherein the means for preventing access comprises an access door having a spring-loaded latch unlockable by a solenoid when the machine drive is in said angular position.

4. The system as claimed in claim 2, wherein said means for preventing access to said changeover means unless the machine drive is in a predetermined angular position comprises a contactless proximity switch detecting a predetermined phase of the turning cylinder with respect to the frame of the printing machine, said first electrical means comprises a contactless proximity switch detecting a predetermined angular position of the calendering means with respect to the machine frame, and said second electrical means comprises a contactless proximity switch detecting a predetermined angular position of the storage cylinder grippers with respect to the machine frame.

5. The system as claimed in claim 1, further comprising a first contactless proximity switch detecting a predetermined angular position of the turning grippers with respect to the machine frame, and wherein said first electrical means comprises a second contactless proximity switch detecting a predetermined angular position of the calendering means with respect to the frame of the printing machine, said second electrical means comprise a third contactless proximity switch detecting the angular position of the storage cylinder grippers with respect to the machine frame, and further comprising means for enabling subsequent printing when said first and second means for detecting locking coincidentally detect locking and said first and second proximity switches coincidentally detect their respective predetermined angular positions, and when said first and second means for detecting locking coincidentally detect locking and said first and third proximity switches coincidentally detect their respective predetermined angular positions.

6. The system as claimed in claim 5, wherein said means for adjusting the turning grippers comprises a changeover lever attached to a hub including cams activating limit switches for detecting respective positions of the hub for first form printing and perfecting, and a solenoid and spring for locking the hub to the frame of the printing machine when the lever is in one of the respective positions for first form printing and perfecting unless the solenoid is energized.

7. The system as claimed in claim 5, wherein said means for preventing access comprises a door and means for inhibiting printing when the door is open, and further comprising means for preventing the closing of said door unless subsequent printing is enabled by said means for enabling subsequent printing.

8. The system as claimed in claim 7, wherein the means for preventing the closing of said door comprises a first spring-loaded latch openable by an energized solenoid, the solenoid being energized in response to the machine drive being stopped and said first proximity switch indicating that the turning grippers are in said first angular position, and further comprising first and second limit switches for sensing whether said means for adjusting the turning grippers are adjusted for first form printing and perfecting, respectively, means for deenergizing said solenoid after said door is opened unless subsequent printing is enabled by said means for enabling subsequent printing, and means for giving an optical indication to the machine operator when said second and third proximity switches indicate their predetermined angular positions for adjustment of said calendering means for perfecting and for adjustment of the relative phase of the cylinders for first form printing, respectively.

9. The system as claimed in claim 8 further comprising a second spring-loaded latch for locking the means for adjusting the turning grippers when the turning grippers are adjusted for first form printing and perfecting, said second latch having a solenoid energized for unlocking when said door is opened, and a third spring-loaded latch for locking the means for adjusting the relative phase between the cylinders, said third latch having a solenoid energized for unlocking when said door is opened.

10. The system as claimed in claim 1, wherein said storage cylinder includes a first shaft coaxial with the storage cylinder and rotatable for adjusting the relative angular position of the calendering means with respect to the storage cylinder, and a second shaft coaxial with the first shaft for locking the angular position of the calendering means with respect to the storage cylinder by rotation of the second shaft with respect to the storage cylinder, and lock detection means comprising a plate substantially perpendicular to the axis of the storage cylinder and mounted for axial movement with respect to the storage cylinder, helical incline means for effecting axial displacement of the plate in response to rotation of the second shaft with respect to the storage cylinder, and proximity detector means mounted on the machine frame for sensing the axial displacement of the plate, so that locking of the calendering means is indicated independent of the angle of the storage cylinder with respect to the press frame.

11. The system as claimed in claim 10 wherein the plate is generally circular and carries a format scale indicating the relative angular position of the calendering means with respect to the storage cylinder.

12. A changeover protection system for a sheetfed rotary printing machine having a storage cylinder with grippers and integral calendering means, a turning cylinder having turning grippers, a machine drive for rotating the cylinders, and means for changeover of the cylinders from a first printing mode to a perfecting mode and vice versa, said means for changeover including means for adjusting and locking the relative phase between the cylinders, means for adjusting and locking the relative angular position of the calendering means with respect to the storage cylinder grippers, and means for adjusting the turning grippers to selectively grip the leading or trailing edge of the sheet on the storage cylinder for first form printing or perfecting, said changeover protection system comprising, in combination, means for preventing printing by the printing machine during adjustment of said means for changeover, a first contactless proximity switch detecting a predetermined angular position of the turning grippers with respect to the frame of the printing machine, a second contactless proximity switch detecting a predetermined angular position of the calendering means with respect to the frame of the printing machine, a third contactless proximity switch detecting a predetermined angular position of the storage cylinder grippers with respect to the machine frame, and electrical means for enabling subsequent printing when said means for adjusting and locking the relative between the cylinders and the means for adjusting and locking the relative angular position of the calendering means are locked when said first and second proximity switches coincidentally detect their respective predetermined angular positions when said turning grippers are adjusted for perfecting, and when said means for adjusting and locking the relative phase between the cylinders and said means for adjusting and locking the relative angular position of the calender means with respect to the storage cylinder grippers are locked when said first and third proximity switches coincidentally detect their respective predetermined angular positions when the turning grippers are adjusted for first form printing, so that when subsequent printing is enabled mechanical interference of the turning grippers with the calendering means due to improper adjustment is prevented.

13. The system as claimed in claim 12, wherein said means for preventing printing by the printing machine during adjustment of said means for changeover comprises a door preventing access to the means for changeover when said door is closed, and means for inhibiting printing when the door is opened, and further including means for preventing the closing of said door unless printing is enabled by said means for enabling subsequent printing.

14. The system as claimed in claim 13 further comprising means for preventing the opening of said door unless said first proximity switch detects said predetermined angular position of the turning grippers with respect to the machine frame.

15. The system as claimed in claim 14, wherein the means for preventing the closing of said door comprises a spring-loaded latch openable by an energized solenoid, the solenoid being energized in response to the machine drive being stopped and said first proximity switch indicating that the turning grippers are in said first angular position, and further comprising first and second limit switches for sensing whether said means for adjusting the turning grippers are adjusted for first form printing or perfecting, respectively; means for deenergizing said solenoid after said door is opened unless subsequent printing is enabled by said means for enabling subsequent printing; and means for giving an optical indication to the machine operator when said second and third proximity switches indicate their respective predetermined angular positions for adjustment of said calendering means for perfecting and for adjustment of the relative phase of the cylinders for first form printing, respectively.

16. In a rotary printing machine having a rotating cylinder journaled to the frame of the printing machine, said cylinder having a concentric adjustment shaft, a contactless sensor for detecting the relative angular position of the adjustment shaft with respect to the cylinder regardless of cylinder rotation comprising, in combination, a plate disposed substantially perpendicular to the axis of said cylinder, means for mounting said plate to the journal of said cylinder and permitting axial displacement of said plate with respect to the journal of said cylinder, helical incline means for effecting axial displacement of said plate in response to rotation of said adjustment shaft, and a contactless proximity sensor mounted to the frame of the printing machine and responsive to the axial displacement of said plate.

17. The contactless sensor as claimed in claim 16, wherein said plate is metallic and said contactless proximity sensor is an inductive sensor.

18. The contactless sensor as claimed in claim 16, wherein said plate is substantially circular and concentric with the axis of said rotating cylinder, and said contactless sensor is disposed adjacent to the peripheral portion of said plate.

19. The contactless sensor as claimed in claim 16, wherein said rotating cylinder is a storage cylinder in a sheet-fed perfecting printing machine, said storage cylinder including calendering means and means for adjusting the angular position of the calendering means with respect to the storage cylinder to adjust for the format size of the printed sheets, and said means for adjusting the format size including a clamping device responsive to the angular position of said concentric adjustment shaft with respect to the storage cylinder, so that said contactless proximity sensor detects locking of the adjustment of the calendering means regardless of rotation of the storage cylinder.

* * * * *